US009085810B2

(12) United States Patent
Serizawa et al.

(10) Patent No.: US 9,085,810 B2
(45) Date of Patent: Jul. 21, 2015

(54) COOLING APPARATUS OF THICK-GAUGE STEEL PLATE

(71) Applicants: Yoshihiro Serizawa, Futtsu (JP); Ryuji Yamamoto, Futtsu (JP); Hisayoshi Matsunaga, Kimitsu (JP); Shigeru Ogawa, Futtsu (JP); Yutaka Akase, Kimitsu (JP); Hironori Ueno, Kimitsu (JP)

(72) Inventors: Yoshihiro Serizawa, Futtsu (JP); Ryuji Yamamoto, Futtsu (JP); Hisayoshi Matsunaga, Kimitsu (JP); Shigeru Ogawa, Futtsu (JP); Yutaka Akase, Kimitsu (JP); Hironori Ueno, Kimitsu (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 0 days.

(21) Appl. No.: 14/072,251

(22) Filed: Nov. 5, 2013

(65) Prior Publication Data

US 2014/0117595 A1 May 1, 2014

Related U.S. Application Data

(63) Continuation of application No. 11/922,715, filed as application No. PCT/JP2005/024178 on Dec. 22, 2005.

(30) Foreign Application Priority Data

Jun. 23, 2005 (JP) ..... 2005-182898

(51) Int. Cl.
*C21D 8/02* (2006.01)
*B21B 45/02* (2006.01)

(52) U.S. Cl.
CPC ..... *C21D 8/0247* (2013.01); *B21B 45/0218* (2013.01); *B21B 45/0233* (2013.01)

(58) Field of Classification Search
CPC ..... B21B 45/02; B21B 1/18; B21B 3/003; B21B 13/103; B21B 45/0206; B21B 45/0218; B21B 37/74; B21B 45/0233; B21B 37/76; B21B 45/0203; C21D 1/00; C21D 9/52; C21D 9/573; C21D 8/02; C21D 8/10; C21D 8/0247; C21D 9/085; C21D 1/20; C21D 9/505
USPC ..... 266/46, 44, 113, 114, 130; 148/637, 148/559, 578, 579, 661, 660, 644, 662
See application file for complete search history.

(56) References Cited

U.S. PATENT DOCUMENTS

2001/0000377 A1* 4/2001 Matsuda et al. ..... 62/65

FOREIGN PATENT DOCUMENTS

JP 11-347629 12/1999
JP 2002-035816 2/2002

(Continued)

OTHER PUBLICATIONS

English Translation of "Effect in controlled-rolling and controlled-cooling process on the steel properties and microstructure of 16 Mn steel," Wuhan Iron & Steel Technical Report (Dec. 31, 1982), pp. 23-30.

(Continued)

*Primary Examiner* — Scott Kastler
*Assistant Examiner* — Michael Aboagye
(74) *Attorney, Agent, or Firm* — Kenyon & Kenyon LLP

(57) ABSTRACT

A cooling method of a thick-gauge steel plate by spraying water from a plurality of spray nozzles on the top and bottom surfaces of the thick-gauge steel plate conveyed between the adjoining pairs of constraining rolls, each comprising a top roll and bottom roll, constraining and conveying the steel plate so as to efficiently cool the top and bottom surfaces of thick-gauge steel plate to secure symmetry of temperatures of the top and bottom surfaces and uniformity of temperature in the plate width direction and achieve improvement of flatness of thick-gauge steel plate and uniformity of quality.

3 Claims, 10 Drawing Sheets

(56) References Cited

FOREIGN PATENT DOCUMENTS

| | | | | |
|---|---|---|---|---|
| JP | 2004-001082 | | 1/2004 | |
| JP | 2004-1082 | A | 1/2004 | |
| JP | 2004001082 | * | 1/2004 | ..... B21B 45/02 |
| JP | 2004-034109 | * | 2/2004 | ..... B21B 45/02 |
| JP | 2004-330238 | A | 11/2004 | |
| JP | 2005118838 | A | 5/2005 | |
| JP | 2005-296976 | A | 10/2005 | |
| JP | 2005296976 | A | 10/2005 | |
| JP | 2006-035311 | A | 2/2006 | |

OTHER PUBLICATIONS

"*Effect in controlled-rolling and controlled-cooling process on the steel properties and microstructure of 16 Mn steel*," Wuhan Iron & Steel Technical Report (Dec. 31, 1982), pp. 23-30.

European Search Report dated Jul. 3, 2008, issued in corresponding European Application No. 05 82 2734.

* cited by examiner (a)

(b)

(a)

(b)

(c)

(a)

(b)

(a)

(b)

(a1) OVAL SPRAY NOZZLE A (a2) OBLONG SPRAY NOZZLE B (b)

COOLING APPARATUS OF THICK-GAUGE STEEL PLATE

This application is a continuation application of U.S. application Ser. No. 11/922,715, filed Mar. 19, 2008, a national stage application of International Application No. PCT/JP2005/024178, filed Dec. 22, 2005, which claims priority to Japanese Application No. 2005-182898, filed Jun. 23, 2005, each of which is incorporated by reference in its entirety.

TECHNICAL FIELD

The present invention relates to a cooling apparatus of thick-gauge steel plate used in the case of cooling finished thick-gauge steel plate when producing thick-gauge steel plate by hot rolling.

BACKGROUND ART

When producing thick-gauge steel plate by hot rolling, to obtain steel plate superior in mechanical properties and having uniform quality characteristics and shape characteristics, the usual practice has been to convey the finished thick-gauge steel plate while being constrained by constraining rolls and to spray the top surface side and bottom surface side with cooling water to cool the two surfaces of the thick-gauge steel plate so as to stably secure symmetry of temperature distribution in the plate width direction of the thick-gauge steel plate and symmetry of temperature distribution in the plate thickness direction.

Regarding this type of cooling, for example, as shown FIG. 9, arranging a line of nozzles 11*s* provided with nozzles 11 long in the steel plate width direction at the top surface side of the steel plate 6 conveyed constrained between the constraining rolls $\mathbf{5}_1$, $\mathbf{5}_2$, each comprised of a top roll 5*a* and a bottom roll 5*b*, arranging a line of nozzles 12*s* provided with more nozzles 12 than the line of nozzles 11*s* of the top surface side at the bottom surface side, and spraying cooling water from the line of nozzles 11*s* and line of nozzles 12*s* on the two surfaces of the steel plate 6 so as to cool the steel plate 6 is disclosed in Japanese Patent Publication (A) No. 11-347629.

In the cooling disclosed in Japanese Patent Publication (A) No. 11-347629, by setting the top surface side line of nozzles 11*s* and the bottom surface side line of nozzles 12*s* so as to make the positions in the length direction of the steel plate where cooling water w starts to strike the steel plate 6 between the constraining rolls $\mathbf{5}_1$, $\mathbf{5}_2$ match at the top surface side and bottom surface side of the steel plate 6, in the cooling process of the steel plate 6, the steel plate 6 is cooled so that the changes in temperature at the fine parts at the top and bottom surfaces become the same (symmetric) about the center plane of thickness of the steel plate 6 as a plane of symmetry.

The top surface side line of nozzles 11*s* used in the cooling disclosed in Japanese Patent Publication (A) No. 11-347629 is comprised of one line of slit nozzles long in the steel plate width direction. Further, the bottom surface side line of nozzles 12*s* is comprised of either slit nozzles, spray nozzles, tubular laminar nozzles, tubular spray nozzles with guide pipes, or multihole nozzles.

In the cooling disclosed in Japanese Patent Publication (A) No. 11-347629, as shown in the examples, one line of slit nozzles is arranged at the top surface side, a plurality of lines of slit nozzles, tubular spray nozzles with guide pipes, tubular laminar nozzles, etc. are arranged over a broad region at the bottom surface side, and the entire region of the bottom surface side of the steel plate is sprayed uniformly with cooling water w without regard as to the position with respect to the top surface side line of nozzles and the regions with plate top water present.

Here, in the cooling process of steel plate, the changes in temperatures at the top and bottom surfaces of the steel plate along with time have to be made the same (symmetrical) about the center plane of thickness of the steel plate as a symmetrical plane, but at the top surface side of the steel plate, there are parts which the water sprays from the nozzles strike and parts where plate top water flows. The cooling abilities at the different parts differ, so it is difficult to make adjustments for changes in said temperatures along with time.

The cooling ability is large and stable at the parts which the water sprays strike, but is small at the parts where plate top water flows. This is because the cooling ability with respect to steel plate differs between the case where the water sprays strike from the vertical direction and the case where water flows in parallel along the steel plate.

At the bottom surface side of the steel plate, there are no factors of instability such as plate top water, so cooling is performed uniformly, but at the top surface side of the steel plate, there is a distribution of magnitude of the cooling ability, so balanced cooling from the top surface side and bottom surface side of the steel plate is difficult.

For this reason, symmetry of temperature of the top surface side and bottom surface side of the steel plate sometimes cannot be sufficiently secured. As a result, there is the problem that that uniformity of flatness and quality of the steel plate is difficult to stably secure.

A cooling method aimed at solving the above problem is disclosed in Japanese Patent Publication (A) No. 2004-1082. In the cooling method disclosed in this publication, as shown in FIG. 10, when using constraining rolls $\mathbf{5}_1$, $\mathbf{5}_2$ to grip and convey high temperature state thick-gauge steel plate and at that time spraying water on the top and bottom surfaces of the thick-gauge steel plate, water is sprayed from one or more lines of top surface side spray nozzles (here, $\mathbf{13}_1$ to $\mathbf{13}_6$) and lines of bottom surface side spray nozzles (here, $\mathbf{14}_1$ to $\mathbf{14}_6$) arranged positioned so as to face the top surface side and bottom surface side.

In the case of the cooling method disclosed in Japanese Patent Publication (A) No. 2004-1082, by spraying water so that the total area of the water spray impact parts formed by the lines of bottom surface side spray nozzles on the surface of the thick-gauge steel plate becomes 60% or more of the area of the steel plate in the region between the constraining rolls $\mathbf{5}_1$, $\mathbf{5}_2$ (substantially region of distance L between centers) and cooling the top and bottom surfaces of the thick-gauge steel plate 6 efficiently and with a good balance, symmetry of the temperatures of the top surface side and bottom surface side of the thick-gauge steel plate 6 is secured, the flatness of the thick-gauge steel plate 6 is improved, and the quality is made uniform.

However, since the area of the water spray impact parts from the lines of spray nozzles arranged positioned facing the top surface side and bottom surface side is made 60% or more of the area of the thick-gauge steel plate area between the constraining rolls $\mathbf{5}_1$, $\mathbf{5}_2$, in particular, at the top surface side, the case where the area of the large thick-gauge steel plate between the constraining rolls $\mathbf{5}_1$, $\mathbf{5}_2$ is substantially covered by the water spray impact surfaces is included. A flow resulting from the discharge of the impacting cooling water and interfering convection parts where the sprays interfere and convect are formed unevenly in the width direction of the thick-gauge steel plate. As a result, there is a concern that the cooling efficiency will drop and the cooling will become uneven.

Further, as shown in the cooling method disclosed in Japanese Patent Publication (A) No. 2004-1082, to secure an area of water spray impact parts of 60% or more of the area of the thick-gauge steel plate between the constraining rolls, for example, as shown in FIG. 11, it is necessary to completely cover the horizontal line part by impacting sprays of water and to ensure that the water sprays impact even the hatched regions between the constraining rolls 5 and the thick-gauge steel plate 6.

For this reason, it is necessary to spray water at a slant at the spaces sandwiched between the constraining rolls 5 and the thick-gauge steel plate 6. An apparatus of a complicated structure configured so as to be able to spray water from a large number of spray nozzles becomes necessary. In the final analysis, there is also the problem that the costs of fabrication of the equipment swells.

DISCLOSURE OF THE INVENTION

The present invention advantageously solves this problem in the conventional cooling method and provides a cooling apparatus of thick-gauge steel plate which, when cooling the top and bottom surfaces of thick-gauge steel plate between pairs of constraining rolls gripping thick-gauge steel plate being conveyed using water sprays from spray nozzles, is able to efficiently cool the top and bottom surfaces of thick-gauge steel plate to secure symmetry of temperatures of the top and bottom surfaces and uniformity of temperature in the plate width direction and achieve improvement of flatness of thick-gauge steel plate and uniformity of quality.

The cooling apparatus of thick-gauge steel plate of the present invention has as its gist the constitutions as set forth in the following (1) to (4) so as to efficiently realize uniform cooling of thick-gauge steel plate (in particular uniform cooling of the top and bottom surfaces):

(1) A cooling apparatus of thick-gauge steel plate having a plurality of pairs of constraining rolls, each comprising a top roll and bottom roll, constraining and conveying hot rolled thick-gauge steel plate and a plurality of spray nozzles spraying water on the top and bottom surfaces of the thick-gauge steel plate conveyed between the adjoining pairs of constraining rolls before and after each other in the conveyance direction, said cooling apparatus of thick-gauge steel plate characterized by arranging said plurality of spray nozzles so that:

(i) the sum of the areas of the impact surfaces of the water sprays from the top surface side spray nozzles on the surface of the thick-gauge steel plate is in the range of 4 to 90% of the surface area of the steel plate between the roll outer circumferences at the closest distance between the pairs of constraining rolls and (ii) the sum of the areas of the impact surfaces of the water sprays from the bottom surface side spray nozzles on the surface of the thick-gauge steel plate is in the range of 4 to 100% of the surface area of the steel plate between the roll outer circumferences at the closest distance between the pairs of constraining rolls.

(2) A cooling apparatus of thick-gauge steel plate as set forth in (1), characterized by arranging said top surface side and bottom surface side spray nozzles so that:

(iii) the sum of the areas of the impact surfaces of the water sprays from the top surface side spray nozzles on the surface of the thick-gauge steel plate is in the range of 4 to 100% of the sum of the areas of the impact surfaces of the water sprays from the bottom surface side spray nozzles on the surface of the thick-gauge steel plate.

(3) A cooling apparatus of thick-gauge steel plate as set forth in (1) or (2), characterized in that said spray nozzles arranged at the top surface side are comprised of one type or more of any of flat spray nozzles, full cone spray nozzles, oval spray nozzles, oblong spray nozzles, and multihole columnar spray nozzles and said spray nozzles arranged at the bottom surface side are comprised of one type or more of any of flat spray nozzles, full cone spray nozzles, oval spray nozzles, and oblong spray nozzles.

(4) A cooling apparatus of thick-gauge steel plate as set forth in any one of (1) to (3), characterized in that said spray nozzles have structures enabling mixed spraying of water and air.

According to the present invention, by selecting the ratio (%) between the sum of the areas of the impact surfaces of the water sprays with the surface of the thick-gauge steel plate in the distance (La) between the roll outer circumferences at the closest distance between the pairs of constraining rolls to be within a prescribed range at the top surface side and bottom surface side of the thick-gauge steel plate, it is possible suppress the uneven formation of pools of impacting spray on the thick-gauge steel plate and thereby stably secure cooling efficiently and achieve uniform temperature of the thick-gauge steel plate after cooling (in particular, secure symmetry of temperatures at the top and bottom surfaces).

As a result, in the present invention, it is possible to improve the flatness of the thick-gauge steel plate and possible to reduce the cold straightening and finishing costs.

Further, according to the present invention, the residual stress in the thick-gauge steel plate can also be reduced and the deformation of the steel plate at the time of working can be suppressed and the work precision can be easily stably secured. Further, according to the present invention, the quality of the thick-gauge steel plate can easily be made uniform.

Further, according to the present invention, by selecting the ratio (%) between the sum of the areas of the impact surfaces of the water sprays with the surface of the thick-gauge steel plate at the top surface side of the thick-gauge steel plate and the sum of the areas of the impact surfaces of the water sprays with the surface of the thick-gauge steel plate at the bottom surface side to be within a prescribed range, it is possible take into consideration the effect of the plate top water and further stably secure symmetry of temperature of the top and bottom surfaces of thick-gauge steel plate and achieve the above effects more reliably.

Further, in the present invention, by structuring the spray nozzles to be able to simultaneously mix and spray water and air, the range of adjustment of the amounts of water can be expanded and further the impact forces of the water sprays can be easily adjusted, so the range of cooling control can be broadened.

As a result, in the present invention, the phenomenon of the impact forces of water sprays against thick-gauge steel plate becoming weaker in the case of reducing the amounts of water can be eased and the desired cooling ability can be easily stably secured.

BEST MODE FOR CARRYING OUT THE INVENTION

Figure 1:
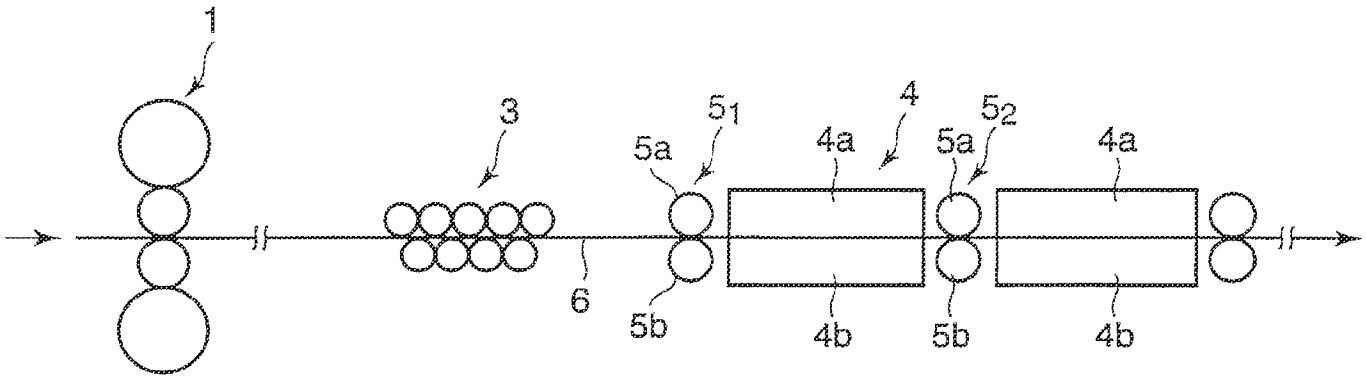
FIG. 1 is a view showing one example of the arrangement of facilities provided with thick-gauge steel plate cooling apparatuses of the present invention.

The present invention covers the cooling of thick-gauge steel plate having a temperature after hot rolling of 700 to 950° C. or so and a thickness of 3 to 150 mm or so and is mainly applied to the case of cooling thick-gauge steel plate by spraying the top surface side and bottom surface side of the thick-gauge steel plate with water from spray nozzles after finishing.

Note that in the present invention, "water" means water, a mixture of water and air, or other cooling media.

When cooling hot rolled high temperature thick-gauge steel plate while conveying it, in general it is cooled by water sprayed from spray nozzles. In this case, if increasing the water spray density per unit area and the water spray impact point density, the cooling ability is increased.

However, when water contacts high temperature thick-gauge steel plate, a boiling phenomenon occurs, so depending on the temperature region of the thick-gauge steel plate, the cooling ability may not increase directly proportionally even if increasing the water spray density and/or water spray impact point density.

For example, if making a large amount of water strike the top surface side of thick-gauge steel plate from the spray nozzles, the regions near the water spray impact points will be cooled, but after impact, the cooling water will form plate top water. The presence of water vapor formed between the cooling water and the thick-gauge steel plate will also have an effect. There is therefore a concern that the water will be discharged without sufficiently contributing to cooling of the thick-gauge steel plate.

Further, when the amount of plate top water is large, the water sprays from the spray nozzles will not be able to sufficiently reach the surface of the thick-gauge steel plate and a sufficient cooling efficiency will not be able to be obtained.

On the other hand, when making a large amount of water sprayed from spray nozzles strike the bottom surface side of thick-gauge steel plate, the regions near the water spray impact points will be cooled, but after impact, the cooling water will separate from the thick-gauge steel plate due to the water vapor formed at the high temperature surface of the thick-gauge steel plate and due to gravity and will not contribute to the cooling, so a sufficiently high cooling efficiency will not be able to be obtained in some cases.

The present invention ensures that the water sprays efficiently reach the surface of the thick-gauge steel plate in certain area regions of the thick-gauge steel plate so as to ease the occurrence of the above phenomenon, stably secure sufficient cooling ability, and improve the cooling efficiency, in particular the symmetry of temperatures at the top and bottom surfaces of the thick-gauge steel plate.

Basically, at the top surface side of thick-gauge steel plate, to suppress the formation of interfering convection parts due to the plate top water which also reduces the cooling efficiency (meaning the flow of water along the top of the plate, in the present invention, referred to as "plate top water"), the water sprays are prevented from striking the radial regions of the constraining rolls so as to suppress the uneven formation of interfering convection parts due to the plate top water on the thick-gauge steel plate, make the high cooling ability water sprays sufficiently reach the surface of the thick-gauge steel plate, stably secure the cooling efficiency, and realize stable cooling.

To secure a cooling ability in accordance with the cooling ability of the top surface side of the thick-gauge steel plate at the bottom surface side of thick-gauge steel plate and stably realize uniform cooling of the top and bottom surface sides of the thick-gauge steel plate, the water sprays are made to strike the bottom surface side of thick-gauge steel plate to balance the cooling ability between the top surface side and bottom surface side.

In the case of cooling at the bottom surface side of thick-gauge steel plate, there is no cooling by plate top water such as with cooling at the top surface side, so it is effective to increase the impact areas of the water sprays at a certain area region of the surface of the thick-gauge steel plate.

Specifically, in a cooling apparatus conveying high temperature thick-gauge steel plate constrained by a plurality of pairs of constraining rolls comprised of top rolls and bottom rolls and spraying the top and bottom surfaces of the thick-gauge steel plate with water to cool the thick-gauge steel plate, large numbers of spray nozzles are respectively arranged at the top surface side and bottom surface side of the thick-gauge steel plate so that the sum of the areas of the impact surfaces of the water sprays from the spray nozzles with the surface of the thick-gauge steel plate becomes within the range of 4 to 90% of the surface area of the steel plate at the distance (La) between the roll outer circumferences at the closest distance between pairs of constraining rolls at the top surface side and within the range of 4 to 100% at the bottom surface side.

Note that in the present invention, a "spray impact part" is defined as a part where the impact pressure of the water spray is 2 kPa or more. In particular, at the top surface side of the thick-gauge steel plate, in the state with the plate top water pooled, the impact pressure of the water spray has to be 2 kPa or more. If the impact pressure of the water spray is less than 2 kPa, the water spray cannot pass through the vapor film formed on the high temperature thick-gauge steel plate due to boiling and reach the steel plate and it is not possible to obtain a sufficient cooling ability.

Figure 12:
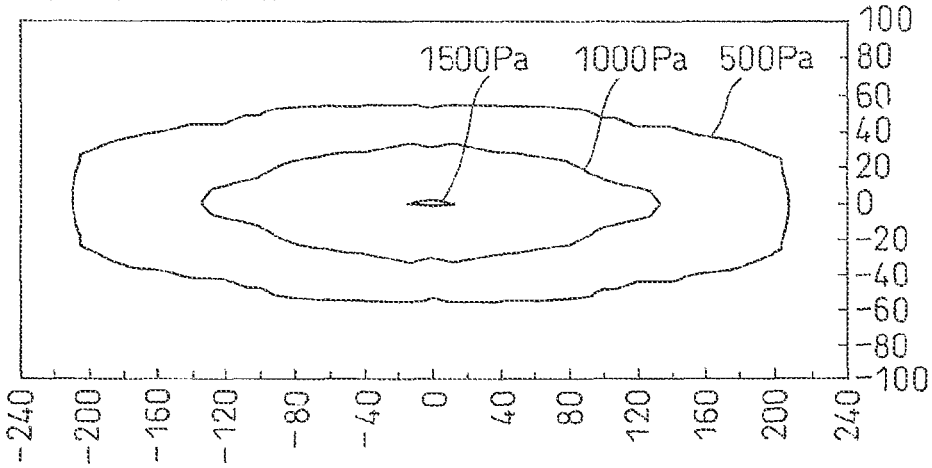
FIG. 12 gives views showing the impact pressure distribution and cooling ability (cooling rate) in the case of spraying water under conditions of a nozzle discharge pressure of 0.3 MPa and a water rate of 100 L/min from spray nozzles at a height of 150 mm. (*a*) shows the distribution of impact pressures in the case of use of oval nozzles A (spread angle: major axis direction 115 degrees/minor axis direction 60 degrees) and oblong nozzles B (spread angle: major axis direction 90 degrees/minor axis direction 25 degrees). (*b*) shows the relationship between the water spray impact pressure and cooling rate in the case of cooling one side of thick-gauge steel plate of a plate thickness of 19 mm. Note that the measurement position is the center of plate thickness.
Figure 12:
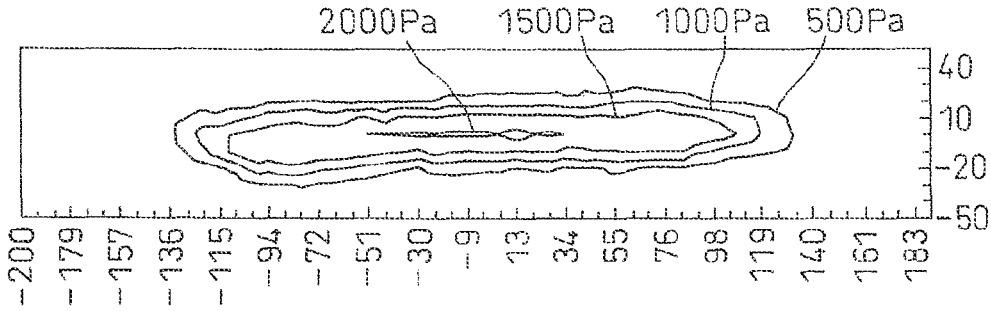
Figure 12:
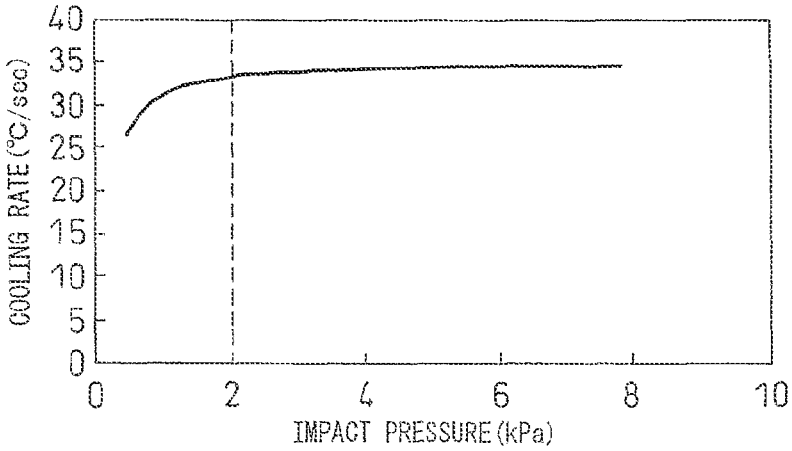

For example, as shown in FIG. 12, if the types of the spray nozzles differ (oval spray nozzles A and oblong spray nozzles B), even with the same nozzle discharge pressures (0.3 MPa) and water rates (100 L/min), the impact pressure distribution greatly changes (see FIG. 12(*a*1) and (*a*2)). At that time, if the impact pressure is 2 kPa or less, the cooling ability (cooling rate) rapidly drops (see FIG. 12(*b*)).

If the sum of the areas of the impact surfaces of the water sprays from the spray nozzles of the top surface side with the surface of the thick-gauge steel plate is less than 4% of the steel plate surface area in the distance (La) between the roll outer circumferences at the closest distance between the pairs of constraining rolls, the areas of the impact surfaces of the water sprays with the surface of the thick-gauge steel plate are not sufficient and a sufficient cooling ability cannot be secured.

The area rate of the impact surfaces is preferably 10% or more. Further, if the area rate of the impact surfaces is over 90%, interfering convection parts of water flows are unevenly formed and the high cooling ability water sprays are obstructed by the plate top water and will not strike the surface of the thick-gauge steel plate and as a result will not contribute sufficiently to the cooling. The flow of water discharged along the thick-gauge steel plate will increase, the cooling efficiency will drop, and the cooling will easily become uneven.

Note that if the area rate of the impact surfaces is 4 to 20%, the ratio of cooling by the plate top water becomes greater and the cooling ability drops somewhat. If changing the amounts of water to adjust the cooling ability, the change in cooling ability with respect to the amounts of water becomes no longer constant and adjustment of the cooling ability becomes somewhat difficult. However, the spray regions are small, so the power used is small and the cooling efficiency is excellent.

Further, if the area rate of the impact surfaces is 80 to 90%, the cooling ability becomes greater along with the increase in the impact areas, but the plate top water starts to pool and the uniformity of cooling in the width direction becomes somewhat inferior. Therefore, the area rate of the top surface side is more preferably 20 to 80%.

If the area rate of the impact surfaces becomes 20% or more, it is possible to sufficiently agitate the regions where the plate top water is present by impacting sprays, so even when adjusting the amount of water, it is possible to determine the cooling ability in accordance with the change of the amount of water.

The sum of the areas of the impact surfaces of the water sprays from the bottom surface side spray nozzles with the surface of the thick-gauge steel plate is basically set so as to balance with the cooling ability of the top surface side, but if less than 4% of the steel plate surface area, the impact surfaces of the water sprays with the surface of the thick-gauge steel plate become insufficient and a sufficient cooling ability cannot be secured. As the area rate, 10% or more is desirable.

The cooling ability is improved together with the increase of the impact areas of the water sprays, so the impact area rate is preferably high. However, if over 95%, interference between sprays starts to occur and the uniformity of cooling falls, so 95% or more is preferable.

Note that when cooling the bottom surface side, the uniformity does not fall as much as the top surface side, so the impact areas may also be 100% (aspect of claim 1).

The spray nozzles are preferably arranged at the top surface side and bottom surface side of the thick-gauge steel plate so that the sum of the areas of the impact surfaces of the water sprays from the top surface side spray nozzles with the surface of the thick-gauge steel plate becomes 4 to 100% of the sum of the areas of the impact surfaces of the water sprays from the bottom surface side spray nozzles with the surface of the thick-gauge steel plate.

At the top surface side, there is a cooling effect due to the plate top water, so the sum of the areas of the impact surfaces of the water sprays from the spray nozzles with the surface of the thick-gauge steel plate can be made smaller than the sum of the areas of the impact surfaces of the water sprays from the bottom surface side spray nozzles with the surface of the thick-gauge steel plate so as to secure the balance of the cooling abilities at the top surface side and bottom surface side.

However, if the sum of the areas of the impact surfaces of the water spray with the surface of the thick-gauge steel plate at the top surface side is less than 4% of the impact surfaces of the bottom surface, the cooling ability of the top surface side becomes too small and the balance of the cooling abilities at the top surface side and bottom surface side becomes difficult to secure.

Further, if the impact areas of the top surface side are less than 30%, the region cooled by the plate top water at the top surface side becomes smaller than the bottom surface side, prediction of change of the cooling ability at the time of adjusting the amounts of water is difficult, the balance of the cooling abilities at the top and bottom surface sides becomes somewhat difficult to adjust.

Further, if the impact areas of the top surface side are over 100%, the cooling ability of the top surface side becomes too large and the balance of the cooling abilities at the top surface side and bottom surface side becomes difficult to secure. Therefore, the impact area rate of the top surface side is preferably 30 to 100% of the impact area rate of the bottom surface side.

At the bottom surface side, there is no effect of the plate top water such as at the top surface side, so the sum of the areas of the impact surfaces of the water sprays is adjusted by suitably selecting spray nozzles so that the cooling ability is balanced with the top surface side (aspect of claim 2).

Note that, Japanese Patent Publication (A) No. 2004-1082 discloses spraying so that the water spray impact parts on the surface of the thick-gauge steel plate occupy 60% or more of the steel plate area between the constraining rolls. This "60% or more" is outside the range of "4 to 90%" of the total area of the water spray impact parts with the thick-gauge steel plate area in the distance (La) between the roll outer circumferences at the closest distance between the pairs of constraining rolls defined at the top surface side in the present invention.

For example, when the diameter of the constraining rolls is 350 mm and the distance between the pair of constraining rolls is 1050 mm, the distance (L) between the centers of the constraining rolls defined in Japanese Patent Publication (A) No. 2004-1082 is 1050 mm, while the distance (La) between the outer circumferences at the closest distance between the pairs of constraining rolls defined in the present invention is 700 mm.

That is, the "60% or more" in accordance with the definition of Japanese Patent Publication (A) No. 2004-1082 means 60% or more of the area of the thick-gauge steel plate in the 1050 mm region. If converted to the area of the thick-gauge steel plate in the 700 mm region of the present invention, this corresponds to "90% or more". This is a condition where it is difficult to sufficiently achieve the object of the present invention.

In the case of cooling the top surface side of thick-gauge steel plate, there is a cooling effect due to the plate top water, so at the water spray impact surface, it is not necessary to completely cover the entire surface of the thick-gauge steel plate. However, the plate top water reduces the forces of the water sprays and is liable to obstruct the water sprays from reaching the surface of the thick-gauge steel plate and to lower the cooling ability, so consideration is required to narrow the spread of the water sprays.

Therefore, it is effective to suitably select, as the spray nozzles arranged at the top surface side, flat spray nozzles, oval spray nozzles, and oblong spray nozzles with a spread angle of the water spray of 0 to 100 degrees, cone spray nozzles with a spread angle of the water spray of 0 to 40 degrees, or multihole columnar spray nozzles (see FIG. 5) and increase the forces of the water sprays reaching the surface of the thick-gauge steel plate.

In the case of cooling the bottom surface side of thick-gauge steel plate, what contributes to the cooling is only the vicinity of the impact surfaces of the water sprays, so nozzles with large impact areas of water sprays are desirable as the spray nozzles arranged at the bottom surface side.

The multihole columnar spray nozzles used at the top surface side are disadvantageous when increasing the impact areas of the water sprays, so are not used as the spray nozzles at the bottom surface side. The bottom surface side spray nozzles are suitably selected for use from flat spray nozzles, oval spray nozzles, and oblong spray nozzles with a spread angle of the water spray of 0 to 100 degrees and full cone spray nozzles with a spread angle of the water spray of 0 to 40 degrees (see FIG. 5). Increasing the area of the impact surfaces of the water sprays with the surface of the thick-gauge steel plate is effective.

Note that the spray nozzles used in the present invention may be a combination of a plurality of types of spray nozzles. It is not necessary to arrange the same types of spray nozzles correspondingly at the top and bottom surface side.

For example, when arranging flat spray nozzles at the first line in the conveyance direction, then arranging a plurality of lines of full cone spray nozzles, it is possible to use the flat spray nozzles to secure uniformity of cooling of the thick-gauge steel plate in the width direction and rapidly cool the surface of the thick-gauge steel plate, then use the full cone spray nozzles to secure uniformity of cooling while increasing the impact area of the water sprays and improving the cooling ability.

Note that, at the time of cooling, cooling after lowering the surface temperature of the thick-gauge steel plate is advantageous in that the boiling mode of the water at the time of cooling starts from the film boiling and transition boiling region.

This is due to the fact that in general, when cooling by water, in the relation between the thick-gauge steel plate surface temperature and cooling ability (in scientific terms, referred to as the "thermal flux"), the thermal flux forms an N-shape, the surface temperature of the thick-gauge steel plate falls, and there is a temperature region where the cooling ability is improved. For this reason, reducing the surface temperature of the thick-gauge steel plate results in a higher cooling ability.

However, when performing this type of cooling by just flat spray nozzles, after the surface temperature of the thick-gauge steel plate is lowered, it is necessary to provide a large number of nozzles so as to increase the impact areas of the water sprays. This is disadvantageous.

Further, full cone spray nozzles and flat spray nozzles differ in impact areas even with the same water rates of the nozzles. Flat spray nozzles can be designed with large water densities at the impact surfaces, so this is advantageous for the case of locally increasing the cooling ability.

In this way, it is possible to design the cooling apparatus by combining various types of spray nozzles considering the characteristics of the spray nozzles. Combining various types of spray nozzles is sometimes advantageous in terms of enhancing the cooling efficiency.

Further, the spray nozzles and their arrangements are set in accordance with cooling conditions preset in accordance with the thick-gauge steel plate conditions, rolling conditions, and temperature/shape conditions sought in the rolling process, but are preferably set so as to enable control of the water density range in accordance with fluctuations in temperature of the thick-gauge steel plate and fluctuations in cooling temperature.

For this purpose, it is necessary to select spray nozzles and arrangements enabling control precision to be easily secured and to give consideration to the arrangement of thermometers, flowmeters, and other sensors and water control apparatuses.

Further, it is also possible to use two-fluid spray nozzles having structures enabling mixing and simultaneous spraying of water and air. Two-fluid spray nozzles have a wide range of adjustment of amounts of water. Further, they are nozzles where adjustment of the impact forces of the water sprays is easy as well. Therefore, if employing two-fluid spray nozzles, the cooling control range can be broadened.

Further, in the case of two-fluid spray nozzles, it is possible to form sufficiently strong sprays by just increasing the amounts of water. The phenomenon of the impact forces becoming weaker if the amounts of water fall is eased, so it is possible to structure the nozzles to spray areas only in the case of small amounts of water. Therefore, it is possible to lighten the economic load involved in spraying air.

The pitch of arrangement in the case of arranging spray nozzles in the width direction of the thick-gauge steel sheet at the top and bottom surface sides differs depending on the type of the nozzles, but basically preferably, from the viewpoint of suppressing the number of nozzles to a minimum, is made a pitch of arrangement where the impact surfaces of the water sprays will not directly interfere with each other.

Further, when arranging the spray nozzles in the conveyance direction of the thick-gauge steel plate, in particular, at the top surface side, preferably, to eliminate the concern over uneven formation of interfering convection parts of the water sprays, the spray nozzles are arranged separated so that the impact surfaces of the water sprays from the spray nozzles adjoining each other in the conveyance direction with the surface of the thick-gauge steel plate will not directly interfere. Further, they are arranged so that when projecting the water sprays from the spray nozzles adjoining each other in the conveyance direction from the conveyance direction on a vertical surface perpendicular to the conveyance direction of the thick-gauge steel sheet, the impact surfaces of the water sprays adjoining each other in the conveyance direction overlap by about 10 to 70% (equivalent) of the area of the impact surfaces in the width direction of the surface of the thick-gauge steel plate.

When arranging the spray nozzles in the conveyance direction at the top surface side of the thick-gauge steel plate, it is preferable to arrange them as explained above so as to reliably ensure uniformity of water density in the thick-gauge steel plate width direction due to the spray nozzles in a unit of one set of constraining rolls in the rolling direction.

Note that the above indicator of overlap differs from the area ratio (indicator) of the "sum of impact areas" with the surface area of steel plate in the distance between roll outer circumferences at the closest distance between pairs of constraining rolls.

If the above indictor of overlap is large, the area rate (indicator) also becomes large, but these indicators do not necessary match.

When arranging the spray nozzles in the width direction of the thick-gauge steel plate, in particular, at the top surface side, preferably, to eliminate the concern over uneven formation of interfering convection part of the water sprays, the spray nozzles are arranged separated so that the impact surfaces of the water sprays from the spray nozzles adjoining each other with the surface of the thick-gauge steel plate will not directly interfere.

There is little concern over uneven formation of interfering convection parts of water sprays in the arrangement of spray nozzles at the bottom surface side, so the spray nozzles may be arranged at both the width direction and conveyance direction of the thick-gauge steel plate so that the impact surfaces of the water sprays from the adjoining spray nozzles interfere.

The types (specifications), numbers, and mode of arrangements of the spray nozzles used at the top and bottom surface sides are selected in accordance with the size of the thick-gauge steel plate (thickness and width), temperature, and cooling target temperature. Further, the regions of arrangement of the spray nozzles at the bottom surface side are set considering the arrangement of spray nozzles at the top surface side and the regions on which plate top water acts so that the cooling ability becomes balanced. For example, the numbers of nozzles are not changed by the posture of the surfaces at the top surface side and bottom surface side and are determined by the types of selected nozzles and impact areas.

EXAMPLE 1

Below, Example 1 of the thick-gauge steel plate cooling apparatus of the present invention will be explained based on FIGS. 1 to 4.

FIG. 1 shows an example of arrangement of a thick-gauge steel plate production facility provided with the thick-gauge steel plate cooling apparatuses of the present invention. Here, a finishing mill 1, hot straightening device 3, pairs of constraining rolls ($\mathbf{5}_1$, $\mathbf{5}_2$), and cooling apparatuses 4 comprised of top surface side cooling apparatuses 4*a* and bottom surface side cooling apparatuses 4*b* arranged between pairs of constraining rolls ($\mathbf{5}_1$, $\mathbf{5}_2$) are successively arranged in the conveyance direction.

In practice, a plurality of pairs of constraining rolls $\mathbf{5}_1$, $\mathbf{5}_2$ are arranged in the conveyance direction and a plurality of top surface side cooling apparatuses 4*a* and bottom surface side cooling apparatuses 4*b* are arranged between said plurality of pairs in the conveyance direction, but here the explanation will be given of the top surface side cooling apparatus 4*a* and bottom surface side cooling apparatus 4*b* arranged between the pair of constraining rolls ($\mathbf{5}_1$, $\mathbf{5}_2$).

Figure 2:
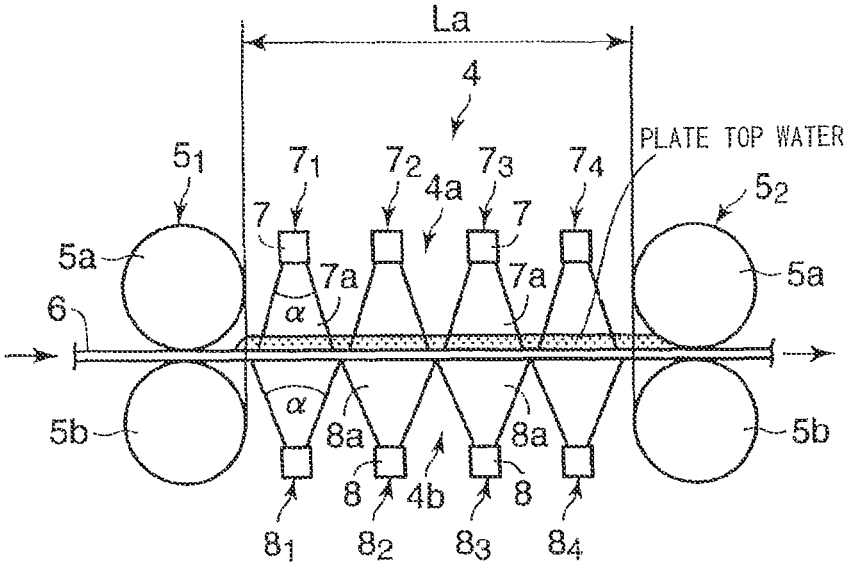
FIG. 2 is a view showing a thick-gauge steel plate cooling apparatus of Example 1 of the present invention.
Figure 4:
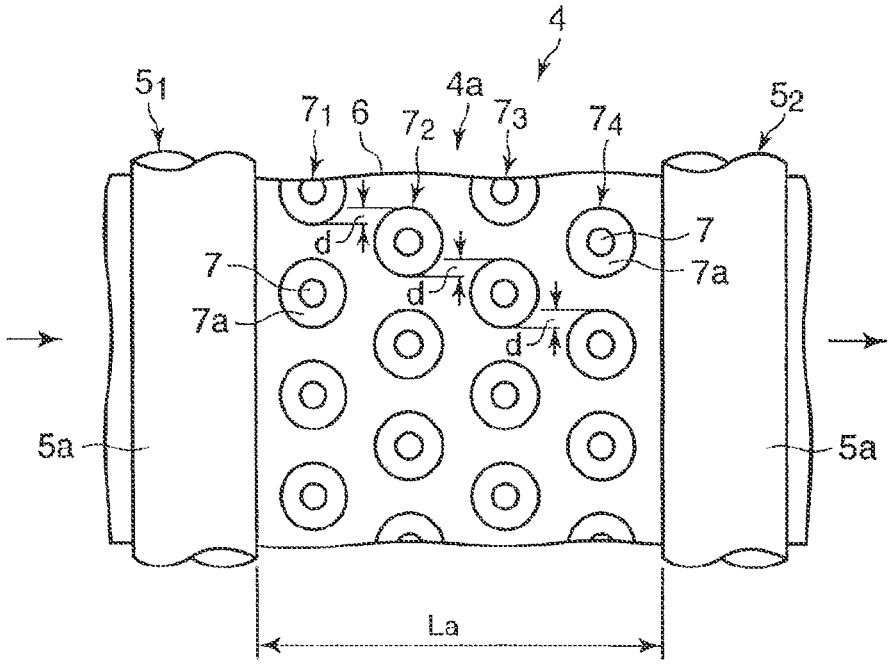
FIG. 4 is a view showing a cooling apparatus shown in FIG. 2 and FIG. 3. (*a*) shows an arrangement of nozzles of a top surface side cooling apparatus. (*b*) shows an arrangement of nozzles of a bottom side cooling apparatus.
Figure 4:
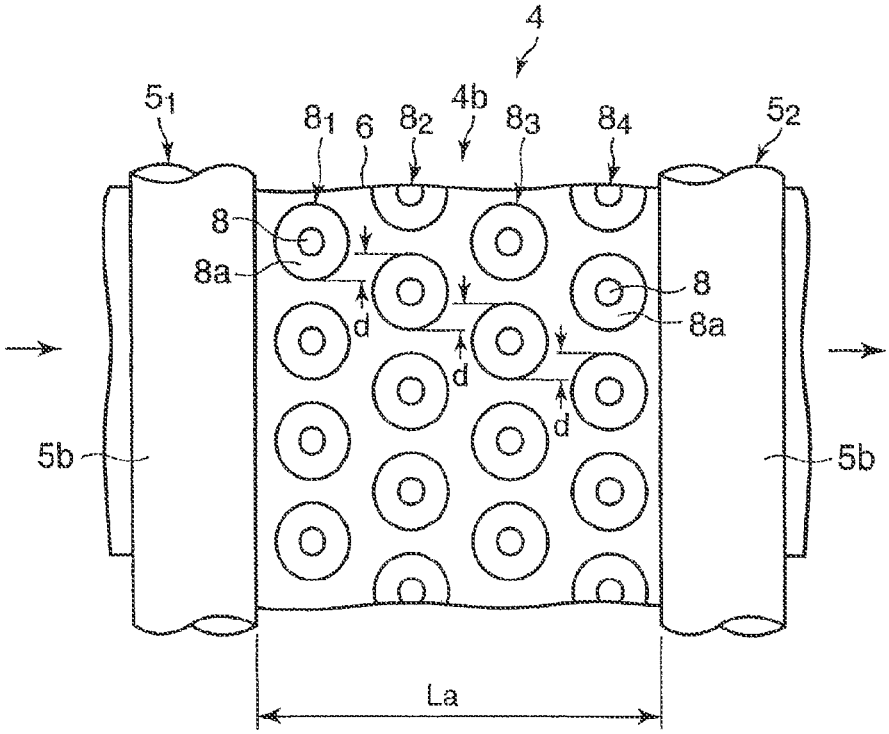

The top surface side cooling apparatus 4*a*, as shown in FIG. 2, is arranged at the top surface side of thick-gauge steel plate 6 conveyed constrained between pairs of constraining rolls $\mathbf{5}_1$, $\mathbf{5}_2$, each comprised of a top roll 5*a* and a bottom roll 5*b*, arranged at the front and back of each other in the conveyance direction. As shown in FIG. 4(*a*), a plurality of full cone spray nozzles 7 are arranged separated in the width direction and conveyance direction of the thick-gauge steel plate 6 so that the impact surfaces of the water sprays 7*a* do not interfere.

Figure 3:
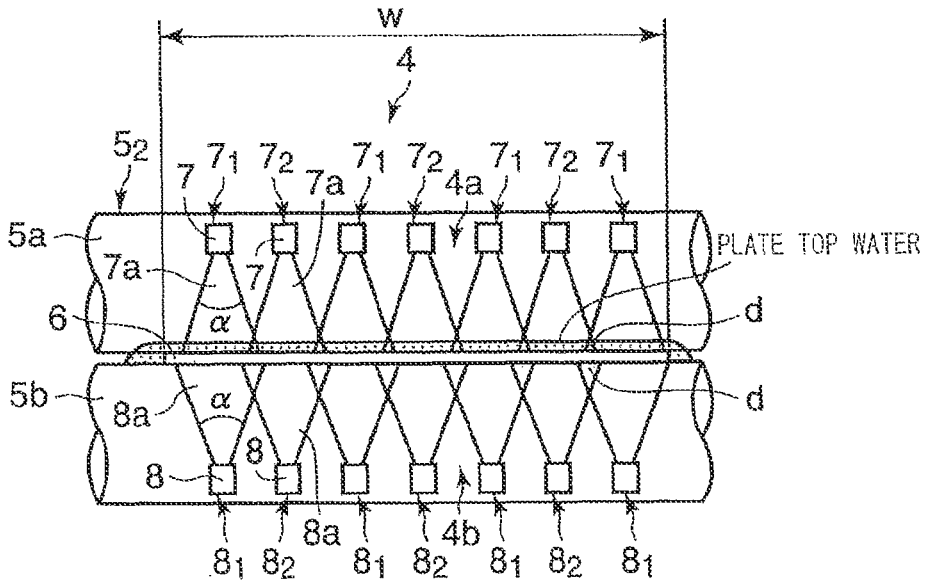
FIG. 3 is a view showing a front surface of the thick-gauge steel plate cooling apparatus shown in FIG. 2.

Here, four lines of nozzles $\mathbf{7}_1$, $\mathbf{7}_2$, $\mathbf{7}_3$, and $\mathbf{7}_4$ are arranged in the conveyance direction of the thick-gauge steel plate 6. Between the lines of nozzles, as shown in FIG. 3, when projecting the water sprays 7*a* on a perpendicular plane from the conveyance direction, the lines of nozzle are arranged so that the impact surfaces of the water sprays 7*a* of the full cone spray nozzles 7 of the lines of nozzles adjoining in the conveyance direction, for example, the lines of nozzles $\mathbf{7}_1$ and $\mathbf{7}_2$, form overlap parts d of about 30% of the areas of the impact surfaces in the width direction of the surface of the thick-gauge steel plate 6.

By employing such an arrangement of lines of nozzles, it is possible to make the water density in the width direction of the thick-gauge steel plate 6 due to the water sprays 7*a* of the full cone spray nozzles 7 from the lines of nozzles $\mathbf{7}_1$ to $\mathbf{7}_4$ uniform.

Figure 5:
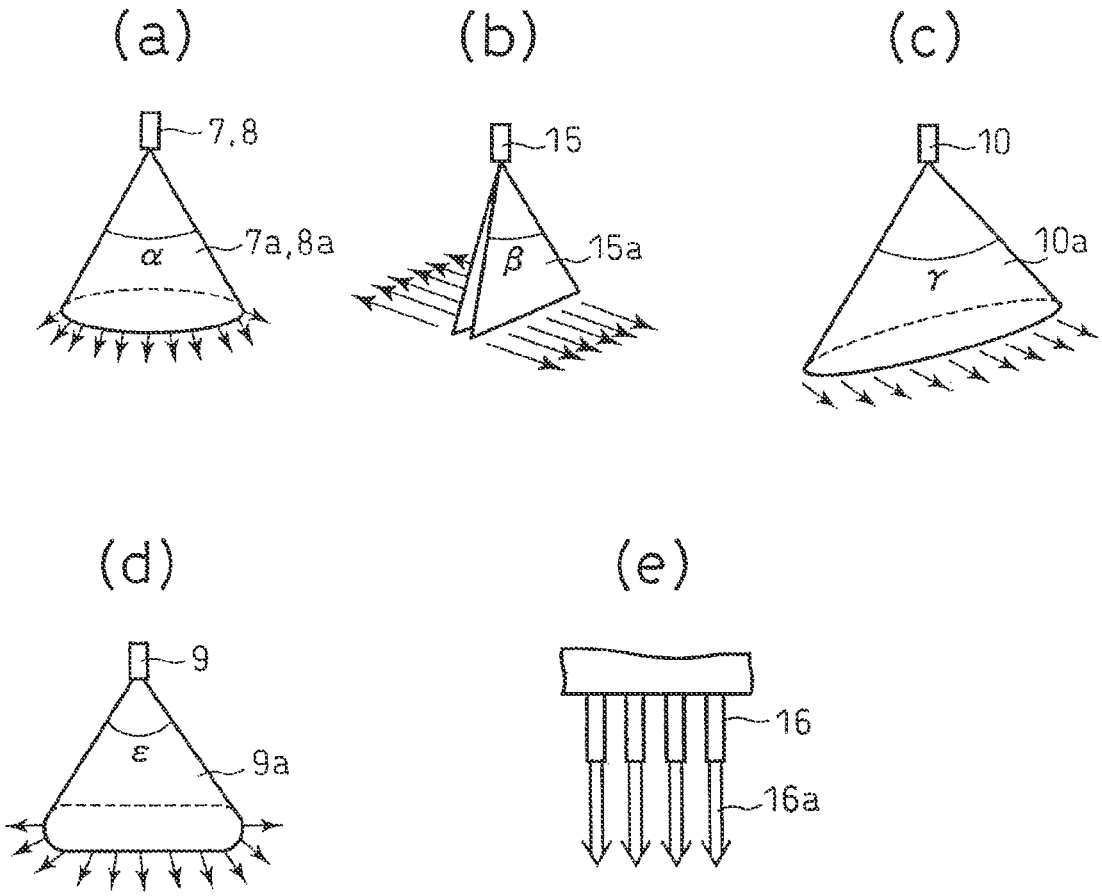
FIG. 5 gives views showing various types of spray nozzles used in the thick-gauge steel plate cooling apparatus of the present invention. (*a*) shows a full cone spray nozzle. (*b*) shows a flat spray nozzle. (*c*) shows an oval spray nozzle. (*d*) shows an oblong spray nozzle. (*e*) shows a multihole columnar spray nozzle.

Each full cone spray nozzle 7 used for the top surface side cooling apparatus 4*a*, as shown in FIG. 5(*a*), has a conical shape of water spray 7*a*, a circular impact surface with the surface of the thick-gauge steel plate 6, and a spread angle $\alpha$ of the water spray 7*a* of 35 degrees.

In the top surface side cooling apparatus 4*a* shown in FIG. 4(*a*), the full cone spray nozzles 7 forming the lines of nozzles $\mathbf{7}_1$ to $\mathbf{7}_4$ are arranged so that the sum So of the areas of the impact surfaces of the water sprays 7*a* of the full cone spray nozzles 7 becomes 40% of the area S of the thick-gauge steel plate (La×thick-gauge steel plate width w) at the distance (La) between roll outer circumferences at the closest distance of the pairs of constraining rolls $\mathbf{5}_1$, $\mathbf{5}_2$.

On the other hand, the bottom surface side cooling apparatus 4*b* is arranged so as to face the top surface side cooling apparatus 4*a* across the thick-gauge steel plate 6. As shown in FIG. 4(*b*), in the same way as the top surface side cooling apparatus 4*a*, a plurality of full cone spray nozzles 8 are arranged separated in the width direction of the thick-gauge steel plate 6 so that the impact surfaces of the water sprays 8*a* do not interfere.

Here, four lines of nozzles $\mathbf{8}_1$ to $\mathbf{8}_4$ are arranged in the conveyance direction of the thick-gauge steel plate 6. Between the lines of nozzles, as shown in FIG. 4(*b*), when projecting the water sprays 8*a* on a perpendicular plane from the conveyance direction, the lines of nozzle are arranged so that the impact surfaces of the water sprays 8*a* of the full cone spray nozzles 8 of the lines of nozzles adjoining in the conveyance direction, for example, the lines of nozzles $\mathbf{8}_1$ and $\mathbf{8}_2$, form overlap parts $\underline{d}$ of about 40% of the areas of the impact surfaces in the width direction of the surface of the thick-gauge steel plate 6.

By employing such an arrangement of lines of nozzles, it is possible to make the water density in the width direction of the thick-gauge steel plate 6 due to the water sprays 8*a* of the full cone spray nozzles 8 from the lines of nozzles $\mathbf{8}_1$ to $\mathbf{8}_4$ uniform.

Each full cone spray nozzle 8 used for the bottom surface side cooling apparatus 4*b*, as shown in FIG. 5(*a*), has a conical shape of water spray 8*a*, a circular impact surface with the surface of the thick-gauge steel plate 6, and a spread angle α of the water spray 8*a* of 40 degrees and therefore differs somewhat from the full cone spray nozzle 7 used for the top surface side cooling apparatus 4*a*.

In the bottom surface side cooling apparatus 4*b* shown in FIG. 4(*b*), the full cone spray nozzles 8 forming the lines of nozzles $\mathbf{8}_1$ to $\mathbf{8}_4$ are arranged so that the sum Su of the areas of the impact surfaces of the water sprays 8*a* of the full cone spray nozzles 8 becomes 50% of the area S of the thick-gauge steel plate (Laxthick-gauge steel plate width w) at the distance (La) between roll outer circumferences at the closest distance of the pairs of constraining rolls $\mathbf{5}_1$, $\mathbf{5}_2$.

In the top surface side cooling apparatus 4*a* of Example 1, the full cone spray nozzles 7 forming the lines of nozzles $\mathbf{7}_1$ to $\mathbf{7}_4$ are arranged so that the sum So of the areas of the impact surfaces of the water sprays 7*a* of the full cone spray nozzles 7 becomes 80% of the sum Su of the areas of the impact surfaces of the water sprays 8*a* of the full cone spray nozzles 8 forming the lines of nozzles $\mathbf{8}_1$ to $\mathbf{8}_4$ at the bottom surface side cooling apparatus 4*b*.

Note that the experimental results of Example 1 correspond to Experimental Example 4 of the later explained Table 1.

EXAMPLE 2

Below, Example 2 of the thick-gauge steel plate cooling apparatus of the present invention will be explained based on FIGS. 6(*a*) to 6(*c*).

Figure 6:
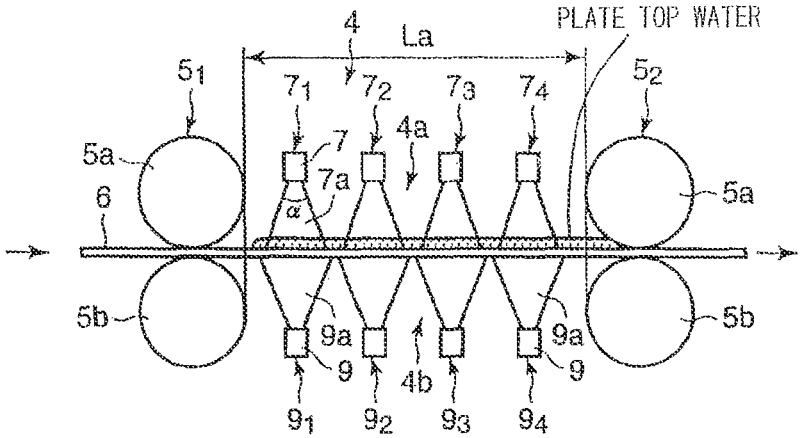
FIG. 6 is a view showing a thick-gauge steel plate cooling apparatus of Example 2 of the present invention. (*a*) shows a side surface of a thick-gauge steel plate cooling apparatus. (*b*) shows a front surface of a thick-gauge steel plate cooling apparatus. (*c*) shows an arrangement of nozzles in the bottom surface side cooling apparatus.
Figure 6:
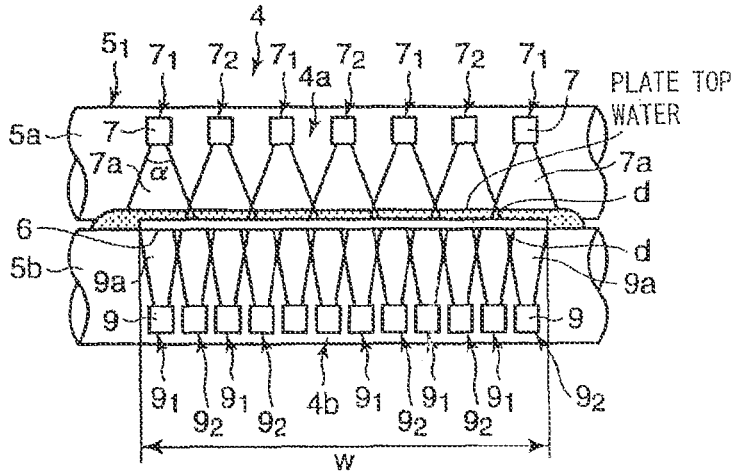
Figure 6:
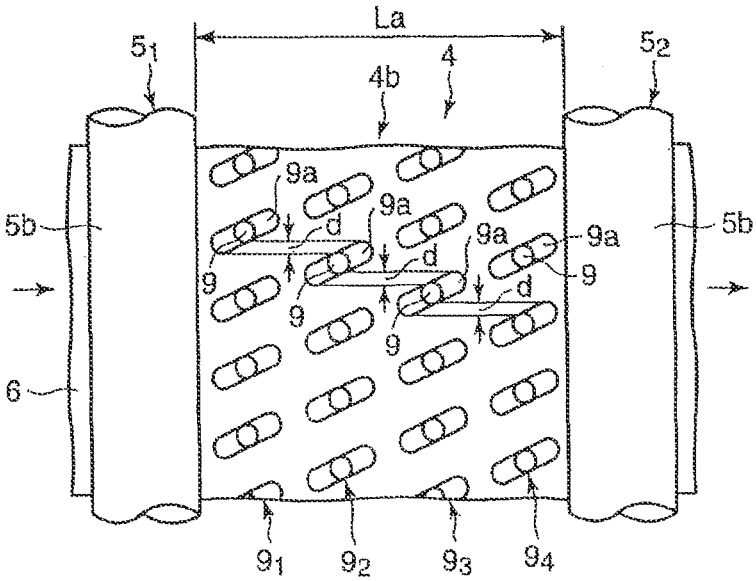

Example 2, like Example 1, has full cone nozzles 7 arranged at the top surface side cooling apparatus 4*a* as shown in FIGS. 6(*a*) and 6(*b*). The full cone nozzles 7 are arranged so that the sum So of the areas of the impact surfaces of the water sprays 7*a* of the full cone spray nozzles 7 with the thick-gauge steel plate becomes 40% of the area S of the thick-gauge steel plate at the distance (La) between roll outer circumferences at the closest distance of the pairs of constraining rolls $\mathbf{5}_1$, $\mathbf{5}_2$.

On the other hand, the bottom surface side cooling apparatus 4*b* is arranged so as to face the top surface side cooling apparatus 4*a* across the thick-gauge steel plate 6. Oblong spray nozzles 9, as shown in FIGS. 6(*a*) and 6(*c*), are arranged with their major axis directions slanted with respect to the conveyance direction and separated so that the impact surfaces of the adjoining water sprays 9*a* with the thick-gauge steel plate 6 do not interfere.

Here, four lines of nozzles $\mathbf{9}_1$, $\mathbf{9}_2$, $\mathbf{9}_3$, and $\mathbf{9}_4$ comprised of pluralities of oblong spray nozzles are arranged in the conveyance direction of the thick-gauge steel plate 6. Between the lines of nozzles, as shown in FIGS. 6(*b*) and 6(*c*), when projecting the water sprays 9*a* on a perpendicular plane from the conveyance direction, the lines of nozzles are arranged so that the impact surfaces of the water sprays 9*a* of the oblong spray nozzles 9 of the lines of nozzles adjoining in the conveyance direction, for example, the lines of nozzles $\mathbf{9}_1$ and $\mathbf{9}_2$, form overlap parts $\underline{d}$ of about 50% of the areas of the impact surfaces in the width direction of the surface of the thick-gauge steel plate 6.

By employing such an arrangement of lines of nozzles, it is possible to make the water density in the width direction of the thick-gauge steel plate 6 due to the water sprays 9*a* of the oblong spray nozzles 9 from the lines of nozzles $\mathbf{9}_1$ to $\mathbf{9}_4$ uniform.

Each oblong spray nozzle 9 used in the bottom surface side cooling apparatus 4*b*, as shown in FIG. 5(*d*), has a substantially fan shape of water spray 9*a*, an oblong impact surface with the surface of the thick-gauge steel plate 6, a spread angle ϵ of the major axis side of the water spray 9*a* of 80 degrees, and a spread angle (θ) of the minor axis side of the water spray 9*a* of 20 degrees.

In the bottom surface side cooling apparatus 4*b*, the oblong spray nozzles 9 of the lines of nozzles $\mathbf{9}_1$ to $\mathbf{9}_4$ are arranged so that the sum Su of the areas of the impact surfaces of the water sprays 9*a* of the oblong spray nozzles 9 becomes 80% of the area S of the thick-gauge steel plate at the distance (La) between roll outer circumferences at the closest distance of the pairs of constraining rolls $\mathbf{5}_1$, $\mathbf{5}_2$.

In the top surface side cooling apparatus 4*a* of Example 2, the area So of the impact surfaces of the water sprays 7*a* of the full cone spray nozzles 7 with the thick-gauge steel plate 6 becomes 50% of the area Su of the impact surfaces of the water sprays 9*a* from the oblong spray nozzles 9 of the bottom surface side cooling apparatus 4*b*.

Note that the experimental results of Example 2 correspond to Experimental Example 5 of the later explained Table 1.

EXAMPLE 3

Below, Example 3 of the thick-gauge steel plate cooling apparatus of the present invention will be explained based on FIGS. 7A(a) and 7A(b) and FIGS. 7B(a) and 7B(b).

Figure 7A:
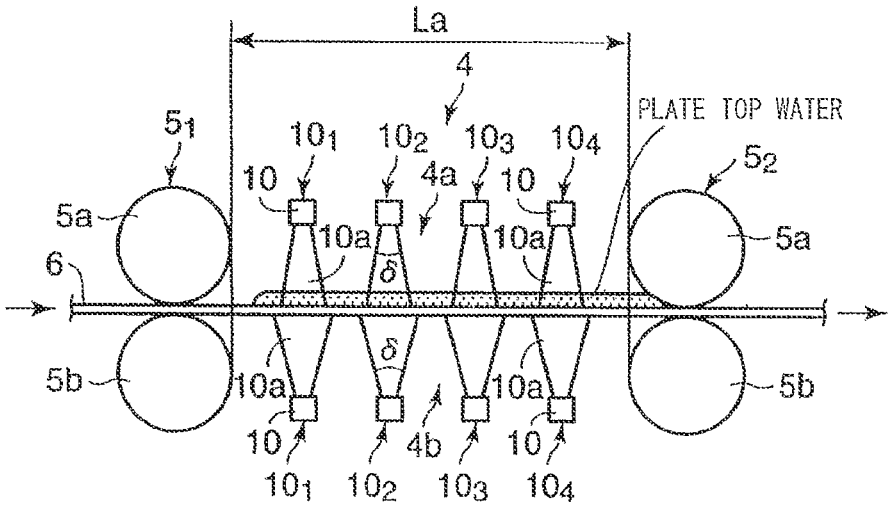
FIG. 7A is a view showing a thick-gauge steel plate cooling apparatus of Example 3 of the present invention. (*a*) shows a side surface of the thick-gauge steel plate cooling apparatus. (*b*) shows the front surface of the thick-gauge steel plate cooling apparatus.
Figure 7A:
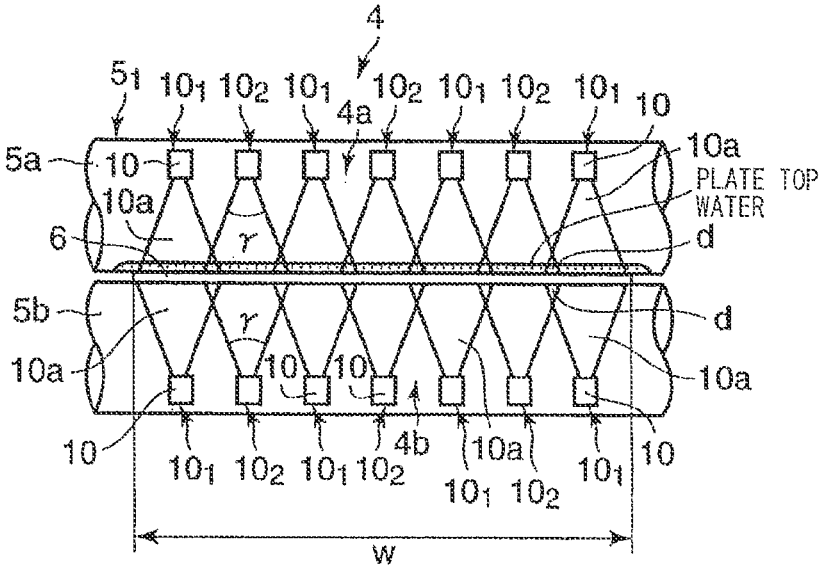
Figure 7B:
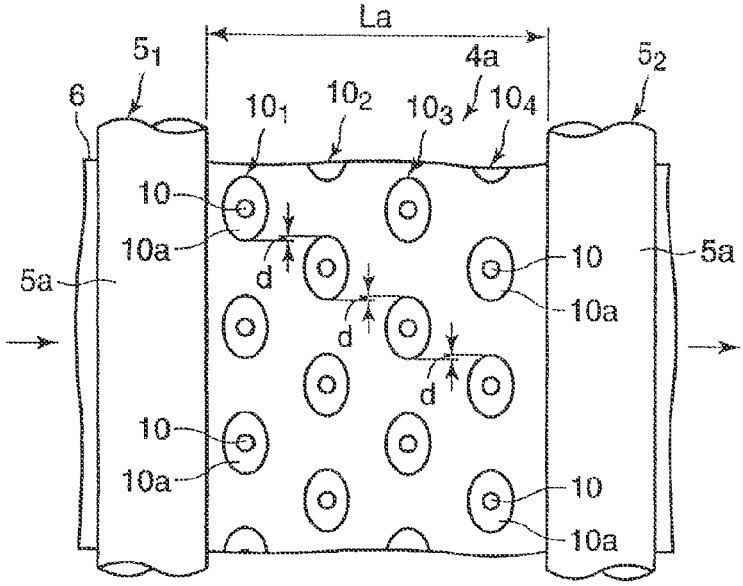
FIG. 7B is a view showing an arrangement of nozzles at a thick-gauge steel plate cooling apparatus shown in FIG. 7A. (*a*) shows an arrangement of nozzles at a top surface side cooling apparatus. (*b*) shows an arrangement of nozzles of a bottom surface side cooling apparatus.
Figure 7B:
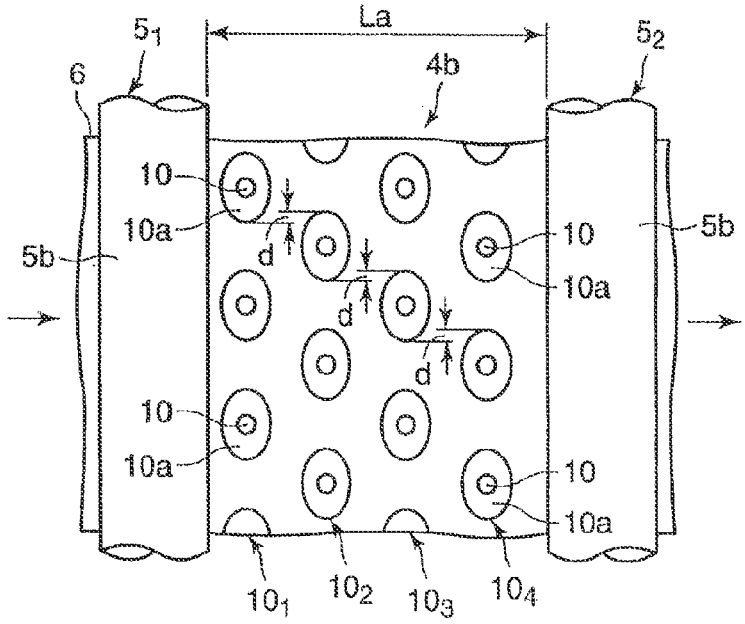

Example 3, like Example 1 and Example 2, has the top surface side cooling apparatus 4*a* arranged as shown in FIG. 7A(a) and has oval spray nozzles 10 shown in FIG. 5(*c*) arranged as shown in FIG. 7B(a) with their major axis directions parallel to the width direction of the thick-gauge steel plate 6 and separated so that impact surfaces of the water sprays 10*a* from the oval spray nozzles 10 adjoining each other in the conveyance direction and width direction of the thick-gauge steel plate 6 do not interfere.

Here, four lines of nozzles $\mathbf{10}_1$, $\mathbf{10}_2$, $\mathbf{10}_3$, and $\mathbf{10}_4$ comprised of pluralities of oval spray nozzles are arranged in the conveyance direction of the thick-gauge steel plate 6. Between the lines of nozzles, as shown in FIG. 7A(b), when projecting the water sprays 10*a* on a perpendicular plane from the conveyance direction, the lines of nozzles are arranged so that the impact surfaces of the water sprays 10*a* of the oval spray nozzles 10 of the lines of nozzles adjoining in the conveyance direction, for example, the lines of nozzles $\mathbf{10}_1$ and $\mathbf{10}_2$, form overlap parts $\underline{d}$ of about 40% of the areas of the impact surfaces in the width direction of the surface of the thick-gauge steel plate 6.

By employing such an arrangement of lines of nozzles, it is possible to make the water density in the width direction of the thick-gauge steel plate 6 due to the water sprays 10*a* of the oval nozzles 10 from the lines of nozzles $\mathbf{10}_1$ to $\mathbf{10}_4$ uniform.

Note that each oval nozzle 10 used in the top surface side cooling apparatus 4*a*, as shown in FIG. 5(*c*), has a substantially fan shape of water spray 10*a*, an oval impact surface with the surface of the thick-gauge steel plate 6, a spread angle γ of the major axis side of the water spray 10*a* of 70 degrees, and a spread angle δ of the minor axis side of the water spray 10*a* of 30 degrees.

At the top surface side cooling apparatus 4*a*, the oval spray nozzles 10 are arranged so that the sum So of the areas of the impact surfaces of the water sprays 10*a* from the oval nozzles 10 of the lines of nozzles $\mathbf{10}_1$ to $\mathbf{10}_4$ becomes 80% of the area S of the thick-gauge steel plate 6 in the distance (La) between roll outer circumferences at the closest distance of the pairs of constraining rolls $\mathbf{5}_1$, $\mathbf{5}_2$.

On the other hand, the bottom surface side cooling apparatus 4*b* is arranged at the bottom surface side of thick-gauge steel plate so as to face the top surface side cooling apparatus 4*a* across the thick-gauge steel plate 6. In the same way as the top surface side cooling apparatus 4*a*, the oval spray nozzles 10 are arranged with their major axis directions parallel to the width direction of the thick-gauge steel plate 6 and to allow impact surfaces of the water sprays 10*a* to interfere in the width direction and conveyance direction of the thick-gauge steel plate 6.

Here, four lines of nozzles $\mathbf{10}_1$, $\mathbf{10}_2$, $\mathbf{10}_3$, and $\mathbf{10}_4$ comprised of pluralities of oval nozzles are arranged in the conveyance direction of the thick-gauge steel plate 6. Between the lines of nozzles, as shown in FIG. 7A(b) and FIG. 7B(a), when projecting the water sprays 10*a* on a perpendicular plane from the conveyance direction, the lines of nozzles are arranged so that the impact surfaces of the water sprays 10*a* of the oval spray nozzles 10 of the lines of nozzles adjoining in the conveyance direction, for example, the lines of nozzles $\mathbf{10}_1$ and $\mathbf{10}_2$, form overlap parts d of about 40% of the areas of the impact surfaces in the width direction of the surface of the thick-gauge steel plate 6.

By employing such an arrangement of lines of nozzles, it is possible to make the water density in the width direction of the thick-gauge steel plate 6 due to the water sprays 10*a* of the oval nozzles 10 from the lines of nozzles $\mathbf{10}_1$ to $\mathbf{10}_4$ uniform.

Each oval spray nozzle 10 used in the bottom surface side cooling apparatus 4*a*, as shown in FIG. 5(*c*), has a substantially fan shape of water spray 10*a*, an oval impact surface with the surface of the thick-gauge steel plate 6, a spread angle γ of the major axis side of the water spray 10*a* of 70 degrees, and a spread angle δ of the minor axis side of the water spray 10*a* of 30 degrees.

At the bottom surface side cooling apparatus 4*b*, the oval spray nozzles 10 of the lines of nozzles $\mathbf{10}_1$ to $\mathbf{10}_4$ are arranged so that the sum Su of the areas of the impact surfaces of the water sprays 10*a* from the oval spray nozzles 10 becomes 100% of the area S of the thick-gauge steel plate 6 in the distance (La) between roll outer circumferences at the closest distance of the pairs of constraining rolls $\mathbf{5}_1$, $\mathbf{5}_2$.

In the top surface side cooling apparatus 4*a* of Example 3, the oval spray nozzles 10 are arranged so that the area So of the impact surfaces of the water sprays 10*a* from the oval spray nozzles 10 with the thick-gauge steel plate 6 becomes 90% of the area Su of the impact surfaces of the water sprays 9*a* from the oval spray nozzles 10 of the bottom side cooling apparatus 4*b* with the thick-gauge steel plate 6.

Note that the experimental results of Example 3 correspond to Experimental Example 6 of the later explained Table 1.

Note that in Examples 1 to 3, the full cone spray nozzles shown in FIG. 5(*a*), oval spray nozzles FIG. 5(*c*), and oblong spray nozzles shown in FIG. 5(*d*) were used, but in the present invention, the flat spray nozzles shown in FIG. 5(*b*), the multihole columnar spray nozzles 16 shown in FIG. 5(*e*) (water spray shape 16*a*), and other spray nozzles able to be sufficiently controlled in spray pressure and spray rate (water density) can be suitably selected for use.

Figure 8:
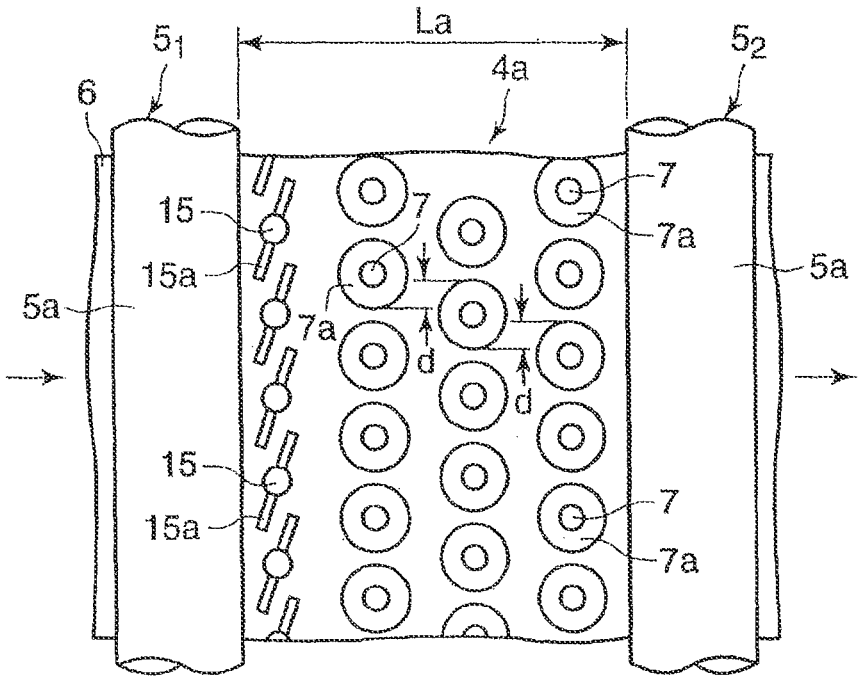
FIG. 8 is a view showing a thick-gauge steel plate cooling apparatus of another embodiment of the present invention (example using a combination of spray nozzles).
Figure 9:
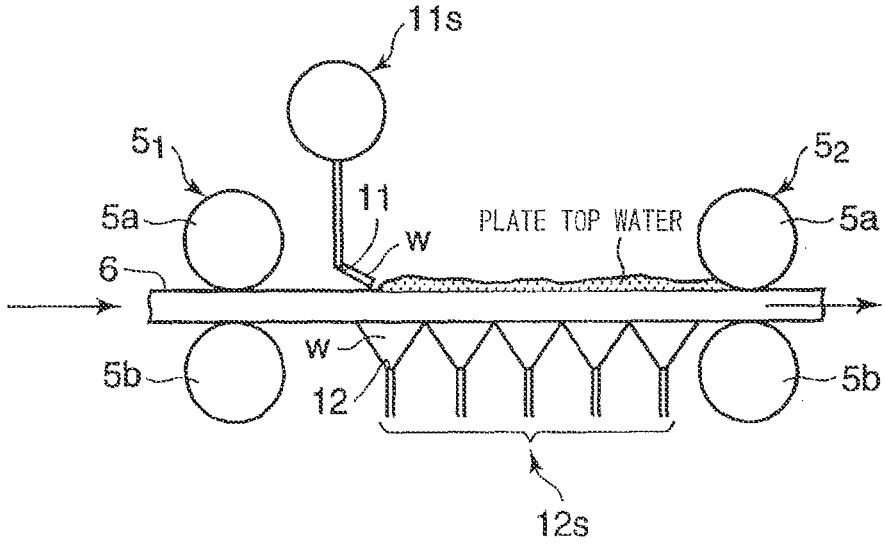
FIG. 9 is a view showing a conventional steel plate cooling apparatus.
Figure 10:
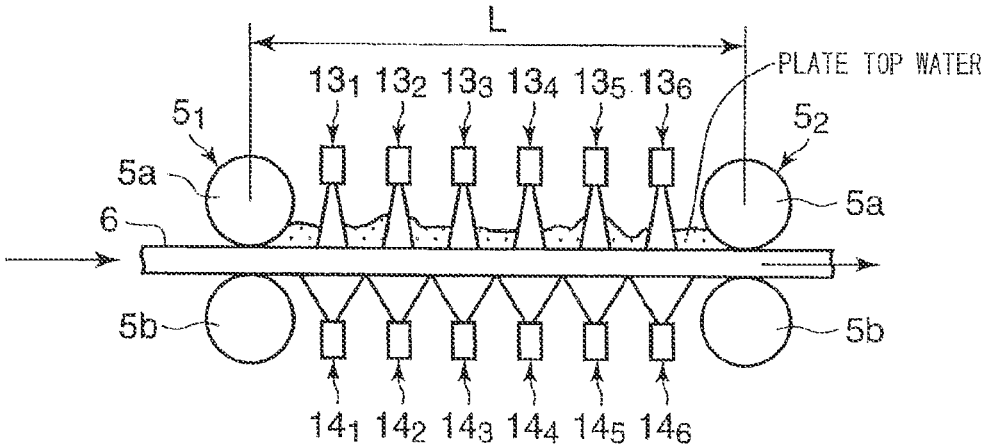
FIG. 10 is a view showing another conventional steel plate cooling apparatus.
Figure 11:
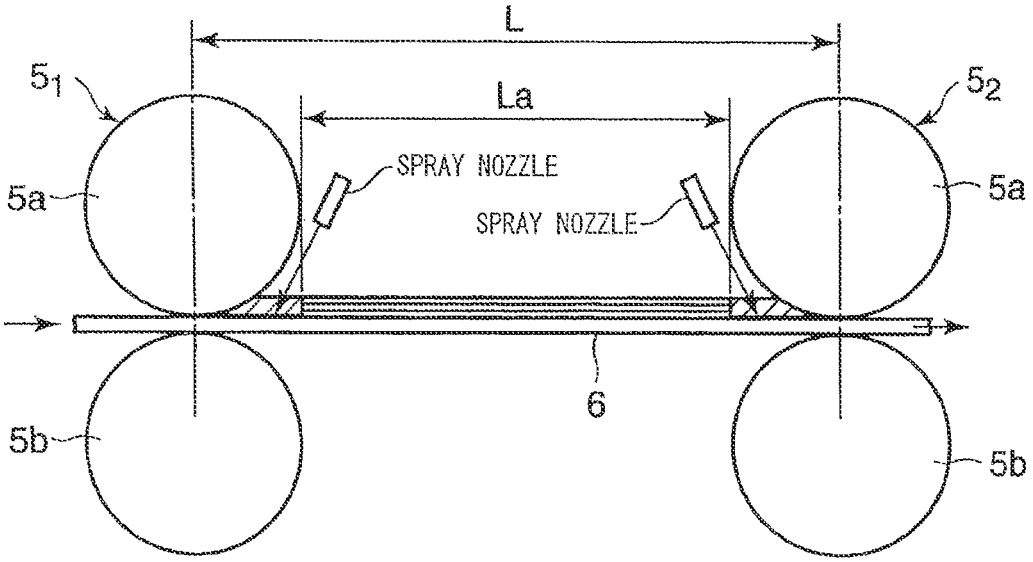
FIG. 11 is a view showing cooling regions and an array of nozzles in the conventional steel plate cooling apparatus shown in FIG. 10.

Further, in the present invention, as shown in FIG. 8, it is also possible to use for example flat spray nozzles 15 having the water spray shapes 15*a* shown in FIG. 5(*b*) and the full cone spray nozzles 7 having the water spray shapes 7*a* shown in FIG. 5(*a*) in combination.

The combination of spray nozzles shown in FIG. 8 was illustrated for the top surface side cooling apparatus 4*a*, but it is possible to similarly combine various types of spray nozzles at the bottom surface side cooling apparatus 4*b* as well.

EXPERIMENTAL EXAMPLES

In the arrangement of facilities shown in FIG. 1, 10 pairs of top surface side cooling apparatuses 4*a* and bottom surface side cooling apparatuses 4*b* arranged between the pairs of constraining rolls were arranged in the conveyance direction of the thick-gauge steel plate 6.

In these 10 pairs of thick-gauge steel plate cooling apparatuses, the types of spray nozzles arranged at the top surface side cooling apparatus 4*a* and bottom surface side cooling apparatus 4*b*, the nozzle specifications, the number of nozzles, the arrangement conditions, the combination conditions, and the ratio So/S, Su/S, and So/Su of the area of the impact surfaces of the water sprays with respect to the surface area of the thick-gauge steel plate 6 were changed to run cooling experiments on the thick-gauge steel plate.

In the cooling experiments, to evaluate the shape defects, unevenness of quality, etc. governing the quality of thick-gauge steel plate 6, three points were used as evaluation indicators, that is, (i) the uniformity of temperature of the thick-gauge steel plate in the width direction, (ii) the uniformity of temperature of the thick-gauge steel plate in the plate thickness direction, and (iii) the difference from the cooling target temperature.

The results are shown in Table 1 along with the results of the comparative examples where the values of So/S, Su/S, and So/Su are outside the range of the present invention.

The comparative examples are examples which satisfy parts of the ranges defined by the present invention, but do not satisfy all of the ranges. The experimental conditions are as explained below. The experimental conditions of the comparative examples are made the same as the experimental examples of the present invention.

(i) The uniformity of temperature of the thick-gauge steel plate in the width direction is shown by the average value of the temperature difference of the top and bottom surfaces of the thick-gauge steel plate 6 in the width direction in the region of the thick-gauge steel plate 6 right after cooling excluding 1 meter at the front and tail ends in the conveyance direction and further excluding 100 mm at the two ends in the width direction. In Table 1, the width uniformity target temperature was set to 30° C.

(ii) The uniformity of temperature of the thick-gauge steel plate in the plate thickness direction is shown by the average value of the temperature difference Of the top and bottom surfaces of the thick-gauge steel plate 6 at the center of the width direction right after cooling (top surface temperature-bottom surface temperature). In Table 1, the top/bottom uniformity target temperature was set to 20° C., (iii) The difference from the cooling target temperature is shown by the difference between the average value of the temperature of the top surface of the thick-gauge steel plate 6 at the center of the width direction right after cooling and the cooling target temperature (resultant temperature-target temperature). In Table 1, a negative value shows a low cooling ability and a positive value shows a high cooling ability.

(Test Conditions)

Thick-gauge steel plate

Plate thickness: 25 mm

Plate width: 4000 mm

Temperature: 800° C.

Cooling target temperature: 500° C.

Cooling time: 10 seconds

Constraining rolls
Roll diameter: 350 mm
Distance between roll centers (L): 1050 mm
Distance between roll outer circumferences (La): 700 mm
Conveyance speed: 70 m/min
Top surface side spray
Water density: 1.0 $m^3/m^2/min$
Spray pressure: 0.2 MPa
Bottom surface side spray
Water density: 1.2 $m^3/m^2/min$
Spray pressure: 0.2 MPa The present invention is not limited to the conditions employed in the above examples. For example, the numbers of top surface side spray nozzles and bottom surface side spray nozzles arranged in the conveyance direction, the types (structures) and specifications of the spray nozzles, the arrangement conditions (numbers and lines), conditions of the water sprayed from the lines of nozzles, size and arrangement conditions of the constraining rolls, etc. can be suitably changed within the scope defined by the claims in accordance with the size of the thick-gauge steel plate being cooled (in particular, the thickness), temperature, conveyance speed, target cooling temperature, cooling time, cooling rate, etc.

TABLE 1

| | | Top surface side spray nozzle | Bottom surface side spray nozzle | So/S (%) | Su/S (%) | Width uniformity target 30° C. | Top and bottom surface uniformity target 20° C. | Difference from cooling target temperature | Overall evaluation |
|---|---|---|---|---|---|---|---|---|---|
| Examples | 1 | flat | flat | 5 | 5 | 30 | 20 | −30 | ○ |
| | 2 | flat | oblong | 5 | 40 | 30 | −10 | −25 | ○ |
| | 3 | flat | oval | 5 | 80 | 30 | −20 | −20 | ○ |
| | 4 | full cone | full cone | 40 | 50 | 25 | 20 | −5 | ○ |
| | 5 | full cone | oblong | 40 | 80 | 25 | 10 | 10 | ○ |
| | 6 | oval | oval | 80 | 100 | 30 | 10 | 30 | ○ |
| | 7 | flat full cone | flat full cone | 80 | 90 | 20 | 10 | 40 | ○ |
| Comparative examples | 1 | flat | flat | 3 | 3 | 40 | 20 | −35 | x |
| | 2 | multihole columnar | oblong | 3 | 6 | 40 | 0 | −30 | x |
| | 3 | multihole columnar | full cone | 3 | 100 | 40 | −30 | −10 | x |
| | 4 | full cone | flat | 40 | 3 | 25 | 60 | −15 | x |
| | 5 | full cone | full cone | 95 | 100 | 50 | 20 | 30 | x |
| | 6 | full cone | flat | 95 | 3 | 50 | 80 | 20 | x |
| | 7 | oblong | oblong | 40 | 20 | 30 | 55 | −10 | x |
| | 8 | oblong | full cone | 40 | 38 | 30 | 25 | −5 | x |

(Note)
Overall evaluation: ○ satisfactory h x unsatisfactory

As shown in Table 1, in Experimental Examples 1 to 7 satisfying the conditions of the present invention (claims 1, 2), when measuring the temperature of the top surface side and the temperature of the bottom surface side of the thick-gauge steel plate 6 after 5 seconds after passing the final exit side constraining rolls $\mathbf{5}_2$, both the evaluation indicators of the two points of said (i) uniformity of temperature of thick-gauge steel plate in the width direction and (ii) uniformity of temperature of thick-gauge steel plate in plate thickness direction were satisfied and it was possible to obtain thick-gauge steel plate 6 with extremely small warping or residual stress, superior in uniformity of both shape and quality, and sufficiently satisfactory in the same.

Note that the average temperature of the cooled thick-gauge steel plate 6 (average value of the temperatures at the centers of the width direction at the top and bottom surfaces) was within the range of ±30° C. of the cooling target temperature and sufficiently satisfactory cooling could be realized.

As opposed to this, in Comparative Examples 1 to 8 satisfying part of the conditions of the present invention but not satisfying all (claims 1, 2) of the conditions, it was not possible to satisfy one or both of the evaluation indicators of (i) and (ii) and it was not possible to obtain thick-gauge steel plate 6 superior in uniformity able to satisfy both the requirements of shape and quality.

Note that the average temperature of the cooled thick-gauge steel plate 6 exceeded the cooling target temperature by 30° C. at the (−) side and a sufficient cooling ability could not be secured.

INDUSTRIAL APPLICABILITY

As explained above, according to the present invention, the flatness of thick-gauge steel plate can be improved, so cold straightening and finishing costs can be reduced. Further, the residual stress can also be reduced and the deformation at the time of working the steel plate can be suppressed and the work precision can be easily stably secured. Further, securing uniformity of quality also becomes easy.

Therefore, the present invention has great applicability in the ferrous metal industry.

The invention claimed is:

1. A method of cooling a thick-gauge steel plate comprising:

spraying water from a plurality of spray nozzles onto a top and a bottom surface of the thick-gauge steel plate conveyed between adjoining pairs of constraining rolls, wherein each pair comprises a top roll and a bottom roll for constraining and conveying the steel plate, wherein the plurality of spray nozzles comprises a line of nozzles arranged in a width direction of the thick-gauge steel plate, wherein a plurality of lines of nozzles are arranged in a conveying direction of the thick-gauge steel plate, and wherein the spray nozzles are arranged such that (i) a sum of areas of a spray impact part impacted by water spraying from the spray nozzles onto the top surface of the thick-gauge steel plate is in the range of 4 to 40% of an area of the top surface of the thick-gauge steel plate, which is between outer circumferences of adjoining top constraining rolls at a closest distance, wherein the spray impact part on the top surface is a part where an impact pressure of the water spray is 2 kPa or more, (ii) a sum of areas of a spray impact part impacted by water spraying from the spray nozzles onto the bottom surface of the thick-gauge steel plate is in the range of 4 to 100% of an area of the bottom surface of the thick-gauge steel plate, which is between outer circumferences of adjoining bottom constraining rolls at a closest distance, wherein the spray impact part on the bottom surface is a part where an impact pressure of the water spray is 2 kPa or more, (iii) the surfaces impacted by water spraying from the spray nozzles do not interfere directly with each other, and (iv) when projecting the water sprays from the spray nozzles onto the top surface of the thick-gauge steel plate from the conveying direction on a vertical surface perpendicular to the conveying direction, the projected surfaces impacted by water spraying adjoining each other in the conveying direction overlap by about 10 to 70% of the area of the surface impacted in the width direction.

2. The method of cooling a thick-gauge steel plate as set forth in claim 1, wherein the spray nozzles are further arranged such that:

(v) the sum of areas impacted by water spraying from the spray nozzles onto the top surface of the thick-gauge steel plate is in the range of 4 to 100% of the sum of the areas impacted by water spraying from the spray nozzles onto the bottom surface of the thick-gauge steel plate.

3. The method of cooling a thick-gauge steel plate as set forth in claim 1, wherein said spray nozzles have structures enabling mixed spraying of water and air.

* * * * *